United States Patent [19]

Eardley et al.

[11] Patent Number: 4,920,237

[45] Date of Patent: Apr. 24, 1990

[54] MEMBRANE KEYBOARDS

[75] Inventors: Richard A. Eardley, Largs; Brian J. Keenan, Merryhill Park; Ian A. Lawson, Largs, all of Scotland; John McAllister, Lexington, Ky.

[73] Assignee: International Business Machines Corporation, Armonk, N.Y.

[21] Appl. No.: 305,585

[22] Filed: Feb. 2, 1989

[51] Int. Cl.[5] ..... H01H 1/14; B41J 19/04; B41J 29/10

[52] U.S. Cl. ..... 200/5 A; 200/517; 341/22; 361/398; 400/479; 400/689

[58] Field of Search ..... 400/479, 689, 472, 690, 400/690.2, 690.3; 200/5 A, 512, 514, 517; 341/22, 34; 361/398

[56] References Cited

U.S. PATENT DOCUMENTS

| | | | |
|---|---|---|---|
| 3,503,031 | 3/1970 | Nyhus et al. | 341/34 X |
| 3,981,757 | 9/1976 | Larson | 400/479 X |
| 4,143,179 | 3/1979 | Nishikata et al. | 400/479 X |
| 4,349,712 | 9/1982 | Michalski | 200/517 X |
| 4,439,647 | 3/1984 | Calandrello et al. | 400/479.1 |
| 4,539,554 | 9/1985 | Jarvis et al. | 341/34 X |
| 4,795,861 | 1/1989 | O'Rourke | 361/398 X |

FOREIGN PATENT DOCUMENTS 3624666 12/1986 Fed. Rep. of Germany .

OTHER PUBLICATIONS

"New Pressure conductive Rubber Changes Keyboard/Switch Concepts", by Amase, pp. 18–24, *JEE* (1/1979).

"Reduction of Bounce & Noise in a Membrane Keyboard", *IBM Technical Disclosure Bulletin*, vol. 28, No. 7, pp. 2773, 12/1985.

*Primary Examiner*—Edgar S. Burr
*Assistant Examiner*—Moshe I. Cohen
*Attorney, Agent, or Firm*—Laurence R. Letson

[57] ABSTRACT

A membrane keyboard has two spaced flexible membranes (1 and 2) carrying contact pad assemblies. Acoustic pads (15) of expanding ink are printed on the top surface of the upper membrane (2) between the contact pads (4) and the key buttons used to operate the contact switches formed by the pairs of opposed contact pads, thus reducing the acoustic noise and improving the contact bounce characteristic.

Optionally, printed expanding ink is also used to form the spacer (5) between the membranes (1 and 2).

3 Claims, 3 Drawing Sheets

MEMBRANE KEYBOARDS

The present invention relates to a membrane keyboard of the type in which two spaced flexible membranes carry a plurality of corresponding contact pads separated by an air gap and more particularly to the forming of a sound deepening layer with screen printed ink thereon.

BACKGROUND OF THE INVENTION

Operation of a key button on the keyboard causes localized deflection of one of two membranes to bring the appropriate contact pads into contact with one another. One problem with such an arrangement is that of contact bounce and acoustic noise. The article at page 2773 of the IBM Technical Disclosure Bulletin Vol. 28, No. 7 (Dec. 1985) illustrates how the acoustic noise and contact bounce characteristics of such a membrane keyboard can be improved by providing a neoprene membrane serving to dampen oscillations of the activated key. Such an arrangement significantly increases the "quality" of the keyboard but does, of course, add to the expense of the keyboard. It has been found that the acoustic noise and contact bounce characteristics can be at least maintained with a significant decrease in the cost of the keyboard by replacing the neoprene with expanding ink pads printed onto the upper surface of the membrane at least adjacent the activating keys.

Expanding inks have been employed mainly in the past for decorative purposes on articles of clothing such as T-shirts and sports shoes. Offenlegungsschrift DE 324666 - A1 describes an electrical membrane switch in which the two membranes are separated by a spacing layer consisting of a layer of ink made from insulating material and printed onto one of the membranes and bonded to the other, either by means of an adhesive or by means of heat and pressure, to produce a laminated assembly. The non-expanding ink is formed from thermoplastic resin in powder form dispersed in a liquid plasticiser with a stabilizing agent, viscosity control agent and a pigment. The spacing layer serves no purpose other than to bond the two membranes together but in spaced relationship.

SUMMARY OF THE INVENTION

In contrast, the present invention uses an expanding ink which has two purposes. Firstly it absorbs acoustic noise caused by operation of the key button. Secondly, it improves the contact bounce characteristics: although the reason is not entirely understood, it is believed that this is because the locally applied ink introduces some extra local rigidity to the membrane in the region of the contact so that the contact remains flatter during its depression and is more quickly restored to its inactive position when the deflection force is removed.

In one embodiment of the invention, a membrane keyboard comprises an array of activating key buttons, a pair of parallelly disposed and spaced flexible membranes located beneath the array of key buttons, each membrane carrying a plurality of contact pads at positions corresponding to the key buttons, and acoustic noise absorbing material located between the key buttons and the membranes, and is characterized in that the acoustic noise absorbing material is constituted by an expanding ink material printed on the membrane adjacent the key buttons at least in the areas thereof corresponding to the positions of the contact pads and key buttons.

In a preferred embodiment, the two membranes are separated by a layer of expanding ink printed on one or both membranes.

According to another aspect of the invention, a method of fabricating a membrane keyboard includes forming contact pads on two membranes, printing expanding ink material on one of the membranes on the side thereof remote from the contact pads, assembling the two membranes in spaced parallel relationship with contact pads on the membrane facing one another, and locating the membranes beneath an array of key buttons with the expanding ink material located adjacent the key buttons In an embodiment, one or both of the membranes may be printed with a layer of expanding ink material surrounding the contact pads on the same side as the pads, the layer or layers thus formed serving to space the membranes apart during the subsequent assembly operation.

DRAWINGS

DETAILED DESCRIPTION OF THE INVENTION

Figure 1:
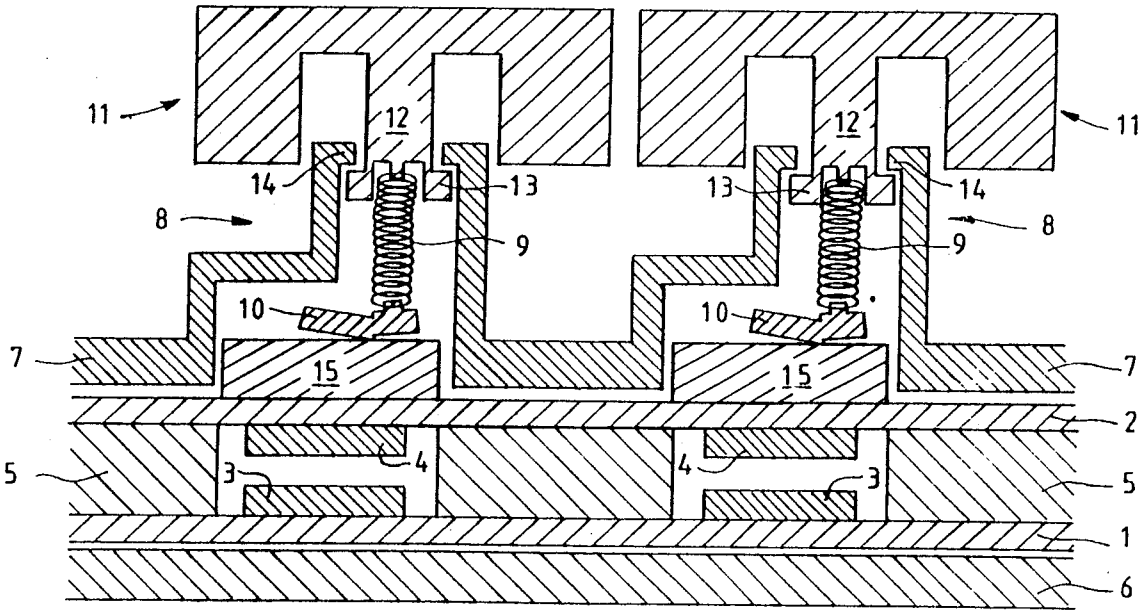
FIG. 1 is a cross-sectional view showing a preferred embodiment of the invention.

Referring now to FIG. 1, which is a sectional view of part of a membrane keyboard, flexible membranes 1 and 2 carry contact pads 3 and 4 respectively. Typically the membranes 1 and 2 are sheets of ICI Corporation's Melinex polyester or Dupont Corporation's Mylar polyester material but any suitable material can be used. The membranes 1 and 2 are separated by a spacer 5, which can be a sheet of insulating material, for example a Melinex or Mylar sheet, or, as will be described below, screen-printed non-conductive material. The spacer 5 keeps the contact pads 3 and 4 out of normal contact with one another. The contact pads 3 and 4 and associated wiring, not shown, are normally screen-printed on the membranes 1 and 2 but any convenient process can be used.

The membrane assembly is supported on a lower support plate 6 which is rigid and which can be generally curved to give a curved profile to the keyboard. Support plate 6 can be of conductive or non-conductive material such as metal or plastics.

Located over and in contact with the membrane 2 is a key button support assembly 7 which includes a number of up-standing support columns 8. The support columns 8 are hollow and contain helical springs 9 which have pivoted keyplates 10 secured to their lower ends. The upper ends of the springs 10 carry key buttons 11. The lower ends of the key button stems 12 have fingers 13 which cooperate with ridges 14 formed on the inside of the columns 8 to prevent the key buttons from being pushed completely out of the columns 8 by the springs 9. However by using a somewhat stronger pressure, the key buttons can be "snapped" into and out of the columns 8 to allow assembly and/or disassembly.

The purpose of the helical springs 9 is twofold. First they support the key buttons 11 and cause their return to the inactive position after activation. Secondly, as they are compressed due to downward movement of the keys they catastrophically buckle within the column 8. As a spring 9 buckles, the keyplate attached to it will pivot and will transfer the downward force to the area of the upper membrane 2 immediately over the contact pad 4. The membrane will flex and make the contact between the upper pad 4 and its associated lower pad 3. The electrical contact will be broken when the key button is released and the pivoted keyplate 10 returns to its inactive position.

As so far described, the keyboard is well known and, conventionally, for quality keyboards, an acoustic blanket of neoprene, not shown, is inserted between the keypads 10 and the upper membrane. As stated in the aforementioned IBM Technical Disclosure Bulletin, the neoprene blanket reduces contact bounce and acoustic noise by absorbing vibrations from the key button assembly. It has been found that the neoprene blanket, which is relatively expensive, can be replaced with printed acoustic pads 15 of expanding ink material which are not only considerably cheaper but, perhaps surprisingly, give a better break characteristic to the switch contacts. The reason for this latter effect is not completely understood but it is thought that this effect is due to the flexible membrane 2 being made locally more rigid by the combination of contact pad 4, membrane 2 and acoustic pad 15.

The expanding ink may be deposited over all of the upper surface of the membrane 2 or its application may be limited to the areas immediately beneath the keybuttons. It has been found that with the latter arrangement there is a saving in material costs with little decrease in effectiveness. One suitable expanding ink is the two-part ink sold by the Serial Group Limited under the trademark Texopaque OP-417. The ink would normally be mixed, screen-printed and then cured. Typical curing temperatures range from about 130 degrees C. to 170 degrees C. Celsius for a few minutes, for example 2 to 3 minutes. The exact curing temperature and time will depend upon the particular expanding ink formulation and, to a certain extent, or the base on which it is printed. Another suitable and preferred ink from the Sericol Group Limited is a pre-mixed (one-part) ink sold under the name Special Texopaque YYR23 which has a typical cure temperature of 120 degrees Celsius for between 2 and 3 minutes.

Another suitable expanding ink appears to be that sold under the trade name Wilflex Nupuff by the Flexible Products Company of Marietta, Georgia, USA, and which is believed to be a polyvinyl chloride resin dispersion. The recommended curing temperatures is 290 to 330 degrees Fahrenheit (about 140 to 170 degrees Celsius) - the lower the temperature, the longer the curing time for optimum expansion.

Optionally, the screen-printed ink may be dried, for example, by heating at a lower temperature, for example at 80 degrees to 90 degrees Celsius, prior to curing. This is useful, for example, when printing on both sides where one side can be printed and dried prior to printing of the other side with a final single curing step. Printing can be by direct silk screening or by transfer printing.

Thus tests have shown that a conventional keyboard with a neoprene acoustic blanket gives a measured noise output of 49 dBA. Replacing the neoprene blanket with screen printed expanding ink acoustic pads as described above resulted in a keyboard having a noise output of 48 dBA. The noise measurement test was repeated after the key had been subjected to over 25 million keystrokes. Although the noise output had increased slightly to 52 dBA, this was still acceptable. Inspection of the key subjected to 25 million keystrokes showed no apparent wear (loss of material) although some smoothing was noticeable (probably due to compaction). Measurement of contact bounce characteristics showed a significant improvement for the expanding ink damped version, both from the point of view of the number of bounces and of their time. The effect was particularly marked on the break bounce characteristic.

Figure 2:
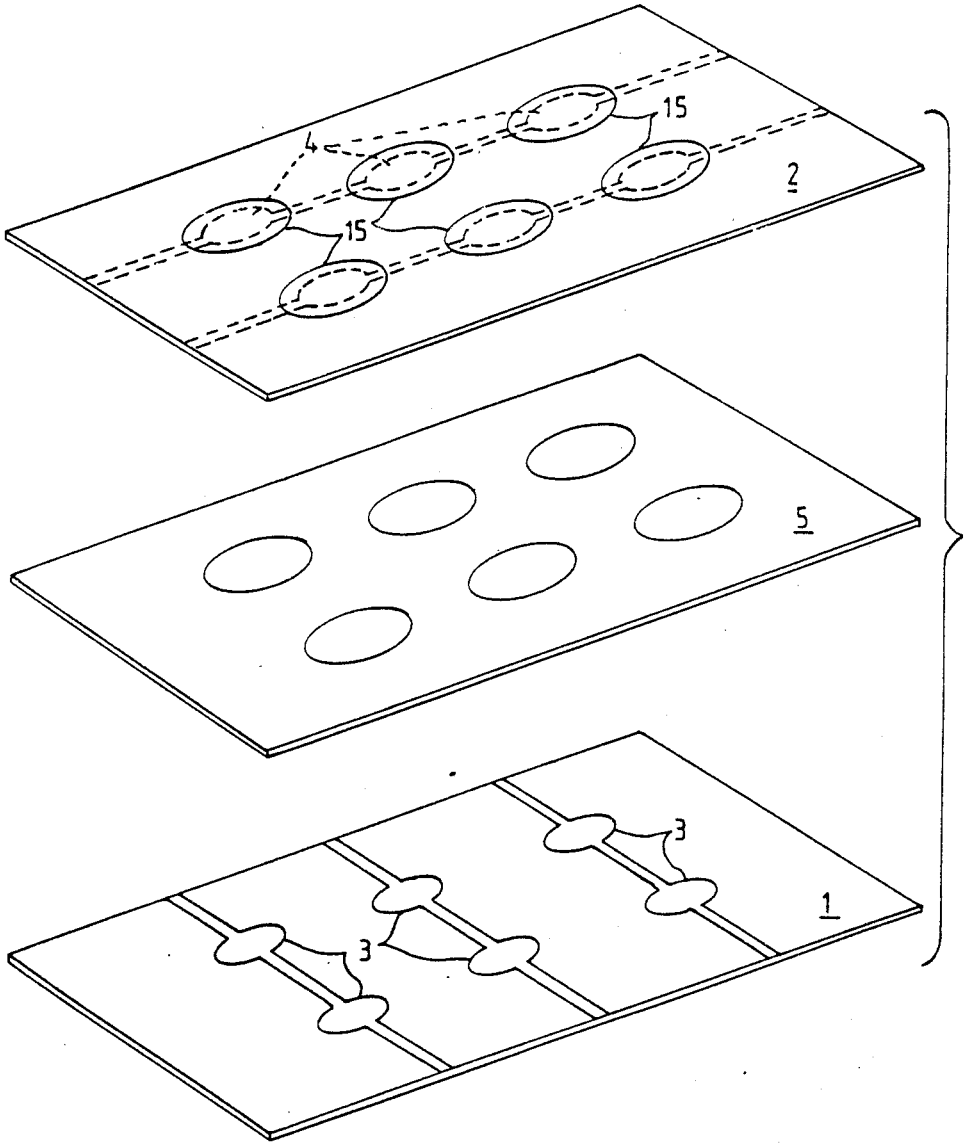
FIG. 2 is an expanded diagram showing a three-part membrane assembly.

FIG. 2 is an expanded diagram showing a three part membrane assembly consisting of lower and upper membranes 1 and 2 carrying contact pads 3 and 4 respectively and separated by an apertured spacer 5. The expanding ink acoustic pads 15 are printed on the top surface of the membrane 2. It will be appreciated that FIG. 2 is a simplified drawing showing only a few key buttons. In practice there will be many more. Apart from spacing the two membranes 1 and 2, the spacer 5 also serves to electrically isolate the interpad wiring on membrane 2 from the interpad wiring on membrane 1.

Figure 3:
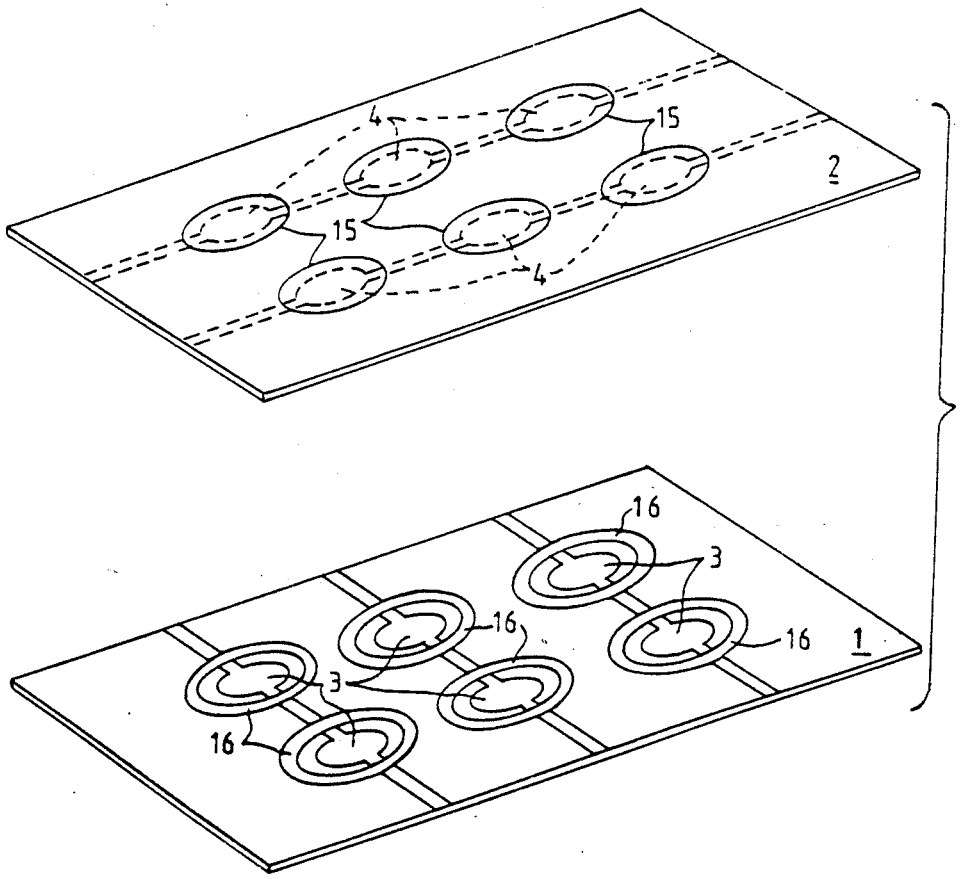
FIG. 3 is an expanded diagram showing a two-part membrane assembly.

As briefly mentioned above with reference to FIG. 1, the spacer 5 may be replaced by printed spacing material on one or both membranes of expanding ink material. Such an arrangement is shown in FIG. 3 in which rings 16 of expanding ink are printed around the contact pads 3 on the lower membrane 1. Rings 16 could, alternatively or additionally, be printed around the contact pads 4 on the upper membrane 2. It has been found that expanding ink material which, after curing, have a total thickness of 100 to 200 microns is adequate although thicker printing can be employed if necessary. Thickness of 200 microns can be obtained with expanding ink in one pass. Additional areas, not shown, on the membranes can be printed with expanding ink to electrically isolate any intersecting printed wiring carried by the two membranes. Although replacing the spacer 5 does result in some material cost saving, this is not as significant as the saving due to replacement of the neoprene sheets. (Neoprene sheets, for instance, are some five times the cost of polyethylene terephtalate sheets.) There is no need to coat the whole of the membrane (except for the pads) with its relative spacing material.

Assembly is simplified whether 2 or 3 part membrane assemblies are used since one or two fewer parts need to be registered with one another. It should be noted that in contrast to the aforementioned DE 3624666 - A1, the membranes are not bonded together into a laminate but are merely positioned in registry with one another and then clamped.

We claim:

1. A membrane keyboard comprising an array of key buttons, a pair of substantially parallelly disposed flexible membranes (1,2) located beneath the array of key buttons, each membrane carrying a plurality of contact pads (3,4) at positions corresponding to the key buttons, and acoustic noise absorbing material located underneath the key buttons above the membranes, said acoustic noise absorbing material comprising an expanding ink material (15) printed on the membrane (2) adjacent the key buttons at least in the areas corresponding to the positions of the contact pads and key buttons.

2. A membrane keyboard as claimed in claim 1, in which the printed expanding ink material is located only at said areas.

3. A method of fabricating a membrane keyboard including forming contact pads on two membranes, printing expanding ink material on one of the membranes at positions corresponding to said contact pads thereon but on the other side of said one membrane, assembling the two membranes in substantially parallel relationship with one another with spacing material preventing the contact pads from contacting one another, and locating the membranes beneath an array of key buttons with the expanding ink material located adjacent the key buttons.

* * * * *